US006644415B1

(12) United States Patent
Mohamed

(10) Patent No.: US 6,644,415 B1
(45) Date of Patent: Nov. 11, 2003

(54) AUTOMATIC ENGINE FIRE EXTINGUISHING SYSTEM

(76) Inventor: Weam S. Mohamed, 5434 Parkside Villa Dr. West, St. Petersburg, FL (US) 33709

( * ) Notice: Subject to any disclaimer, the term of this patent is extended or adjusted under 35 U.S.C. 154(b) by 68 days.

(21) Appl. No.: 09/999,139

(22) Filed: Nov. 30, 2001

(51) Int. Cl.[7] ..... A62C 3/07
(52) U.S. Cl. ..... 169/62; 169/54; 169/60
(58) Field of Search ..... 169/54, 56, 60, 169/62

(56) References Cited

U.S. PATENT DOCUMENTS 3,387,662 A 6/1968 Molgano, Jr.
3,515,218 A 6/1970 Gardner et al.
3,889,752 A * 6/1975 Dunn ..... 169/62
4,986,365 A 1/1991 Shieh
D315,970 S 4/1991 Ramos et al.
5,613,564 A 3/1997 Rhines
5,934,379 A * 8/1999 Ostlyngen et al. ..... 169/62
5,941,315 A 8/1999 Lai et al.
5,960,888 A * 10/1999 Moore, Sr. ..... 169/62

* cited by examiner

*Primary Examiner*—Steven J. Ganey

(57) ABSTRACT

An automatic engine fire extinguishing system for automatically detecting and extinguishing an engine fire of a vehicle permitting a user to exit the vehicle without having to worry about actuating the fire extinguishing system. The system includes at least one canister that is mountable to the vehicle and positionable adjacent to the engine. The canister has an interior for holding a fire extinguishant under pressure. A valve is mounted on the canister for controlling a flow of the fire extinguishant from the canister. A conduit is coupled to the valve for carrying the fire extinguishant flowing through the valve away from the canister. The conduit has at least one opening for emitting the fire extinguishant from the conduit. At least one fire detector is provided for detecting a fire and opening the valve permitting the fire extinguishant to flow through the conduit exiting the opening and extinguishing a fire.

9 Claims, 3 Drawing Sheets

AUTOMATIC ENGINE FIRE EXTINGUISHING SYSTEM

BACKGROUND OF THE INVENTION

1. Field of the Invention

The present invention relates to fire extinguishing systems and more particularly pertains to a new automatic engine fire extinguishing system for automatically detecting and extinguishing an engine fire of a vehicle permitting a user to exit the vehicle without having to worry about actuating the fire extinguishing system.

2. Description of the Prior Art

The use of fire extinguishing systems is known in the prior art. More specifically, fire extinguishing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,941,315; U.S. Pat. No. 4,986,365; U.S. Pat. No. 5,613,564; U.S. Pat. No. 3,387,662; U.S. Pat. No. 3,515,218; and U.S. Pat. No. Des. 315,970.

While these devices fulfill their respective, particular objectives and requirements, the aforementioned patents do not disclose a new automatic engine fire extinguishing system. The inventive device includes at least one canister that is mountable to the vehicle and positionable adjacent to the engine. The canister has an interior for holding a fire extinguishant under pressure. A valve is mounted on the canister for controlling a flow of the fire extinguishant from the canister. A conduit is coupled to the valve for carrying the fire extinguishant flowing through the valve away from the canister. In one embodiment of the present invention, the conduit has at least one opening for emitting the fire extinguishant from the conduit. At least one fire detector is provided for detecting a fire and opening the valve permitting the fire extinguishant to flow through the conduit exiting the opening and extinguishing a fire.

In these respects, the automatic engine fire extinguishing system according to the present invention substantially departs from the conventional concepts and designs of the prior art, and in so doing provides an apparatus primarily developed for the purpose of automatically detecting and extinguishing an engine fire of a vehicle permitting a user to exit the vehicle without having to worry about actuating the fire extinguishing system.

SUMMARY OF THE INVENTION

In view of the foregoing disadvantages inherent in the known types of fire extinguishing systems now present in the prior art, the present invention provides a new automatic engine fire extinguishing system construction wherein the same can be utilized for automatically detecting and extinguishing an engine fire of a vehicle permitting a user to exit the vehicle without having to worry about actuating the fire extinguishing system.

The general purpose of the present invention, which will be described subsequently in greater detail, is to provide a new automatic engine fire extinguishing system apparatus and method which has many of the advantages of the fire extinguishing systems mentioned heretofore and many novel features that result in a new automatic engine fire extinguishing system which is not anticipated, rendered obvious, suggested, or even implied by any of the prior art fire extinguishing systems, either alone or in any combination thereof.

To attain this, the present invention generally comprises at least one canister that is mountable to the vehicle and positionable adjacent to the engine. The canister has an interior for holding a fire extinguishant under pressure. A valve is mounted on the canister for controlling a flow of the fire extinguishant from the canister. A conduit is coupled to the valve for carrying the fire extinguishant flowing through the valve away from the canister. In one embodiment of the present invention, the conduit has at least one opening for emitting the fire extinguishant from the conduit. At least one fire detector is provided for detecting a fire and opening the valve permitting the fire extinguishant to flow through the conduit exiting the opening and extinguishing a fire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic engine fire extinguishing system apparatus and method which has many of the advantages of the fire extinguishing systems mentioned heretofore and many novel features that result in a new automatic engine fire extinguishing system which is not anticipated, rendered obvious, suggested, or even implied by any of the prior art fire extinguishing systems, either alone or in any combination thereof.

It is another object of the present invention to provide a new automatic engine fire extinguishing system which may be easily and efficiently manufactured and marketed.

It is a further object of the present invention to provide a new automatic engine fire extinguishing system which is of a durable and reliable construction.

An even further object of the present invention is to provide a new automatic engine fire extinguishing system which is susceptible of a low cost of manufacture with regard to both materials and labor, and which accordingly is then susceptible of low prices of sale to the consuming public, thereby making such automatic engine fire extinguishing system economically available to the buying public.

Still yet another object of the present invention is to provide a new automatic engine fire extinguishing system which provides in the apparatuses and methods of the prior art some of the advantages thereof, while simultaneously overcoming some of the disadvantages normally associated therewith.

Still another object of the present invention is to provide a new automatic engine fire extinguishing system for automatically detecting and extinguishing an engine fire of a vehicle permitting a user to exit the vehicle without having to worry about actuating the fire extinguishing system.

Yet another object of the present invention is to provide a new automatic engine fire extinguishing system which includes at least one canister that is mountable to the vehicle and positionable adjacent to the engine. The canister has an interior for holding a fire extinguishant under pressure. A valve is mounted on the canister for controlling a flow of the fire extinguishant from the canister. A conduit is coupled to the valve for carrying the fire extinguishant flowing through the valve away from the canister. In one embodiment of the present invention, the conduit has at least one opening for emitting the fire extinguishant from the conduit. At least one fire detector is provided for detecting a fire and opening the valve permitting the fire extinguishant to flow through the conduit exiting the opening and extinguishing a fire.

Still yet another object of the present invention is to provide a new automatic engine fire extinguishing system that can save lives by permitting a user of a vehicle to exit the vehicle as soon as a fire is detected. The prior art provides several fire extinguishing systems that employ a lever or some actuating means to extinguish the engine fire. The time a user spends trying to actuate the fire extinguishing system may result in the user being injured or killed by fire or an explosion. The present invention reduces the amount of time a user spends in a vehicle by employing a fire detector that triggers the fire extinguishing system.

Even still another object of the present invention is to provide a new automatic engine fire extinguishing system that can save a user money. The sooner an engine fire is detected and extinguished the less damage that generally results. The prior art requires that the user detect the fire so that the user can extinguish the fire. However, the present invention employs fire detectors that can sense a fire long before a user. The present invention extinguishes the fire sooner saving the user money on costly repairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
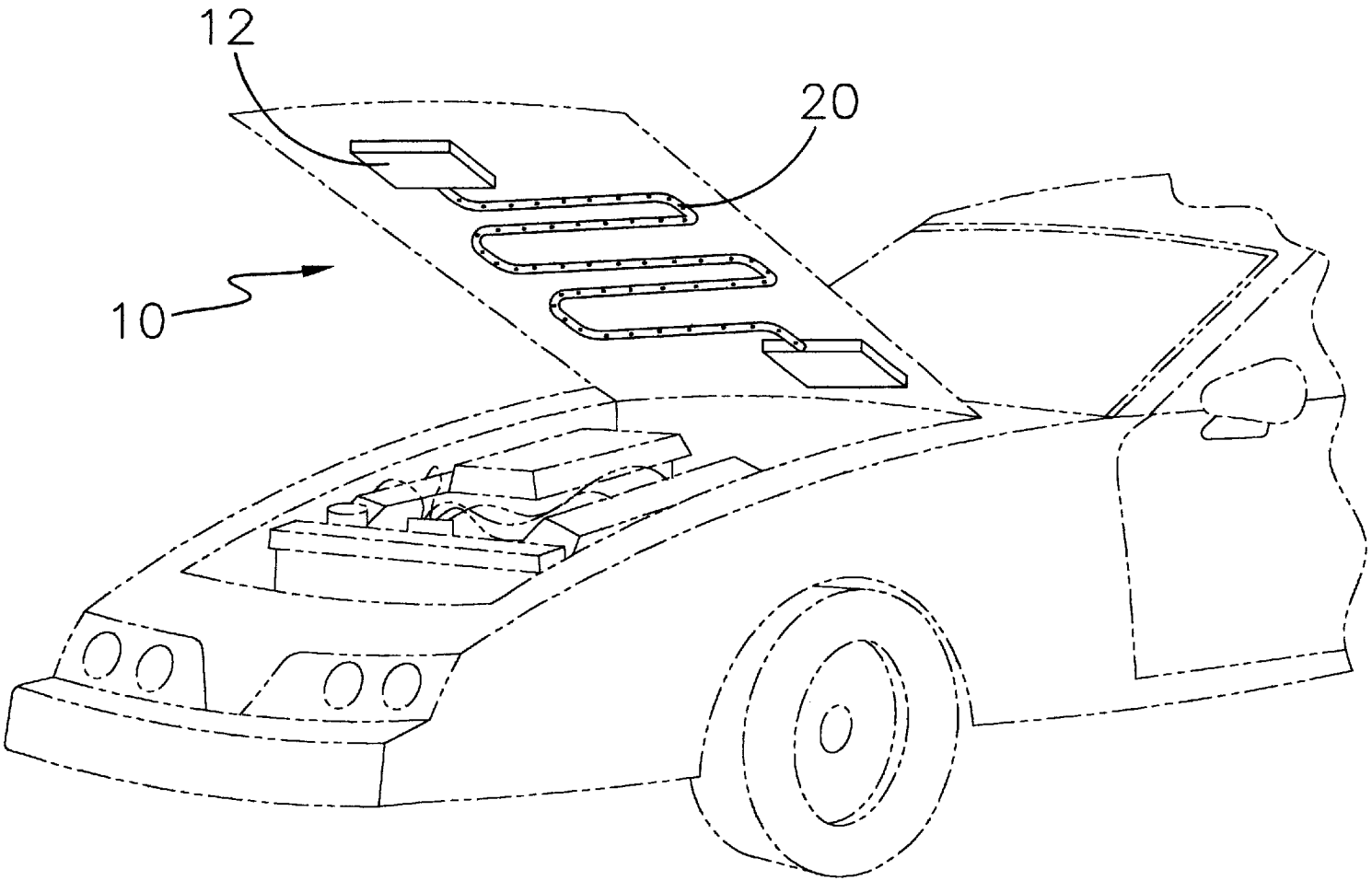
FIG. 1 is a schematic perspective view of a new automatic engine fire extinguishing system according to the present invention.
Figure 2:
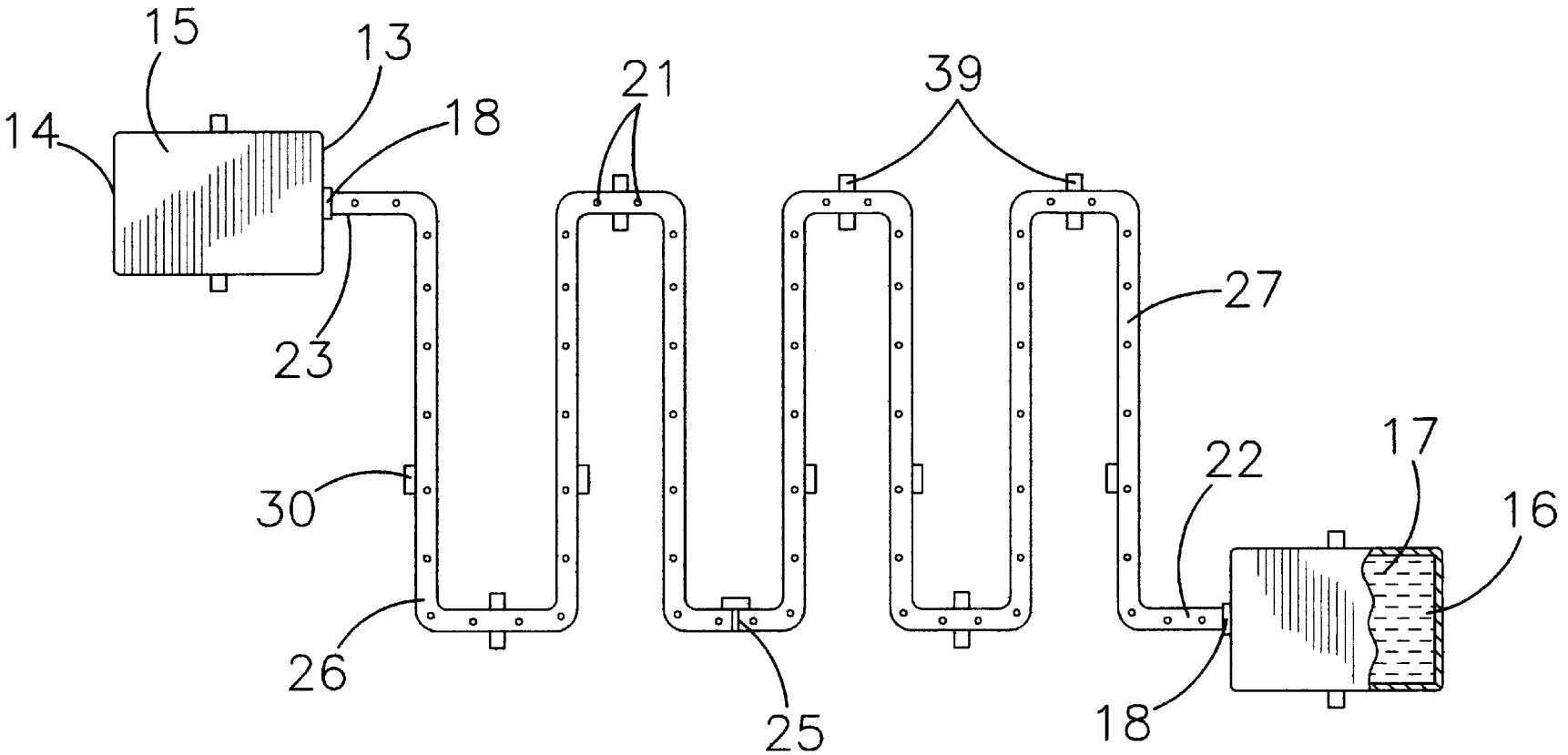
FIG. 2 is a schematic bottom view of the present invention.
Figure 3:
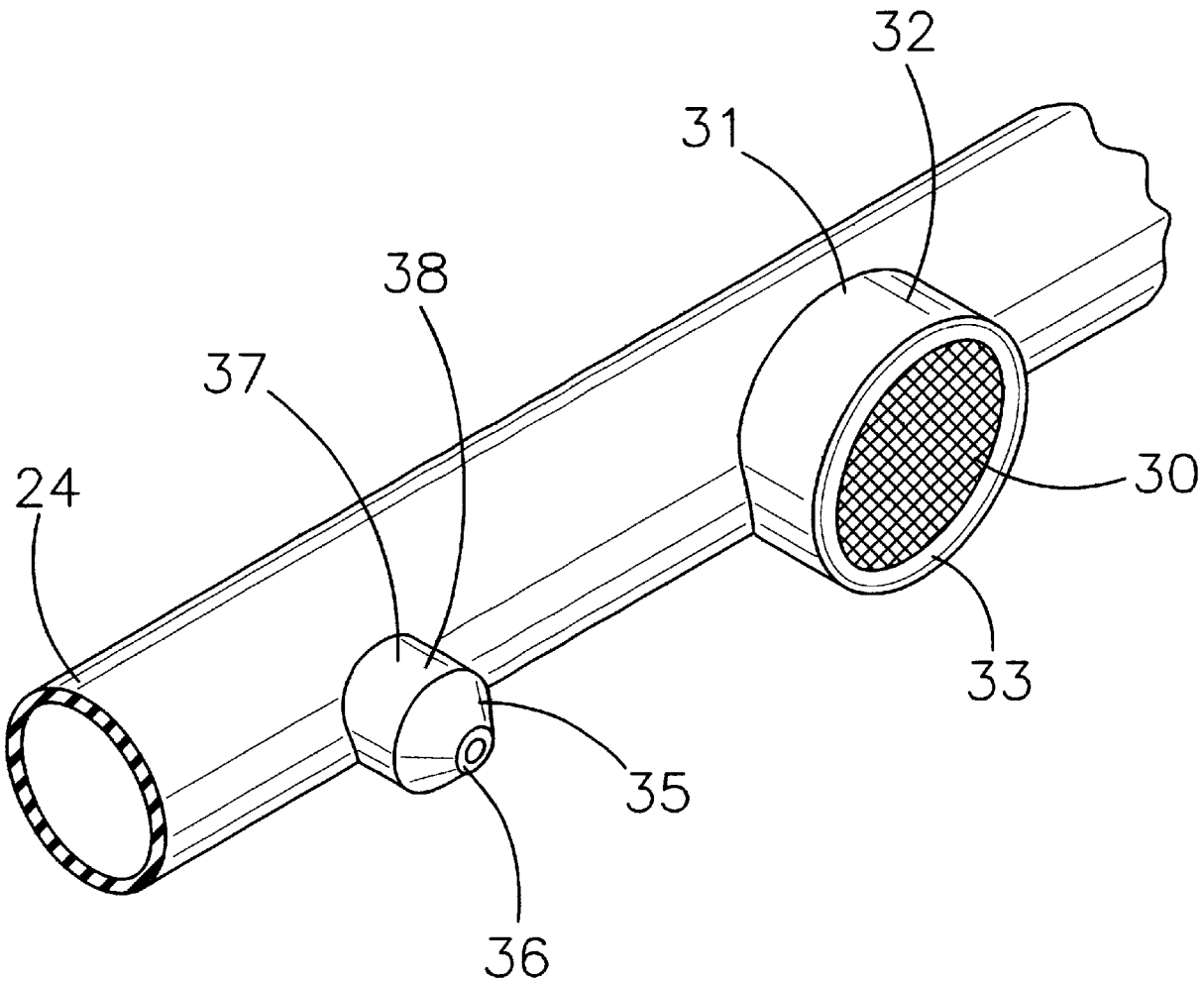
FIG. 3 is a schematic perspective view of the present invention.

With reference now to the drawings, and in particular to FIGS. 1 through 3 thereof, a new automatic engine fire extinguishing system embodying the principles and concepts of the present invention and generally designated by the reference numeral 10 will be described.

As best illustrated in FIGS. 1 through 3, the automatic engine fire extinguishing system 10 generally comprises a pair of canisters 12 that are mountable to the vehicle adjacent to the engine. Each of the canisters 12 may be mountable to the underside of a hood of a vehicle for positioning the fire extinguishing system 10 above the engine of the vehicle.

Each of the canisters 12 may have a first end 13, a second end 14 and a peripheral wall 15 extending between the first 13 and second 14 ends of each of the canisters 12 defining an interior 16 of each of the canisters 12. The pair of canisters 12 may comprise a substantially rigid material such as, for example a steel or aluminum material. Each of the canisters 12 preferably comprises a material capable of withstanding the high temperatures of a engine and a fire.

A fire extinguishant 17 is positioned in the interior 16 of each of the canisters 12. The fire extinguishant 17 is preferably under pressure from compressed air or an aerosol being used to position the fire extinguishant 17 into the interior 16 of each of the canisters 12.

In one embodiment of the present invention, the fire extinguishant 17 may comprise carbon dioxide. A fire needs two elements in order to burn. First, a fire needs some type of material such as, for example, wood, plastic or a flammable liquid such as gasoline that can burn. Second, a fire needs oxygen in order to fuel the fire. Carbon dioxide is a chemical having properties capable of suffocating a fire by preventing the fire from obtaining oxygen, thereby extinguishing the fire. However, other types of fire extinguishants such as, for example, water may also be employed.

A valve 18 is mounted on each of the canisters 12 for controlling a flow of the fire extinguishant 17 from each of the canisters 12. Each of the valves 18 may be mounted on one of the ends 13 or 14 of each of the canisters 12. Each of the valves 18 is in communication with the interior 16 of each of the canisters 12.

Any valve capable of controlling the flow of the fire extinguishant out of each of the canisters 12 may be employed. In one embodiment of the present invention, a thermostat type valve may be employed to open up at a particular temperature spraying the fire extinguishant over the engine on fire.

A conduit 20 is preferably coupled to and extends between each of the valves 18 for carrying the fire extinguishant 17 flowing through the valves 18 away from each of the canisters 12. The conduit 20 may have a plurality of openings 21 extending into the conduit 20 for emitting the fire extinguishant 17 from the conduit 20.

An engine generally has areas that are hard to reach. The conduit 20 would permit the fire extinguishant 17 to spray the fire extinguishant over more of the engine reaching the hard to reach areas of the engine.

The conduit 20 has a first end 22, a second end 23 and a peripheral wall 24 extending between the first 22 and second 23 ends of the conduit 20. In one embodiment of the present invention, the conduit 20 comprises a generally flexible material such as, for example, a rubber material. The conduit 20 preferably comprises a generally fire resistant material since the effectiveness of the fire extinguishing system 10 may be reduced if the conduit 20 was damaged due to a fire.

As illustrated in FIG. 2, an intermediate wall 25 may be mounted in the conduit 20 dividing the conduit into a first portion 26 and a second portion 27. In one embodiment of the present invention, the intermediate wall 25 increases pressure of the fire extinguishant 17 flowing through each of the portions 26 and 27 of the conduit 20. Additionally, if one of the valves 18 happened to malfunction the other canister 12 would only have to pressurize half of the conduit 20. This would ensure that the fire extinguishing system 10 would have enough pressure to spray fire extinguishant onto the engine.

As illustrated in FIG. 3, a plurality of fire detectors 30 are mounted on the peripheral wall 24 of the conduit 20 for detecting a fire and opening the valves 18 mounted on each of the canisters 12, permitting the fire extinguishant 17 to flow through the conduit 20 and exit each of the openings 21 and extinguishing a fire.

In one embodiment of the present invention, each of the fire detectors 30 is designed for detecting a temperature above a predetermined temperature of a engine in a vehicle. This is to ensure that the fire detectors 30 do not mistake the heat from the engine as a fire and trigger a false alarm, spraying fire extinguishant 17 onto the engine.

In one embodiment of the present invention, each of the fire detectors 30 is designed for detecting smoke. Any type of fire detector capable of detecting smoke may be employed. At the first sign of smoke, each of the fire detectors 30 would open each of the valves 18 permitting the fire extinguishant 17 to spray over the engine.

Each of the fire detectors 30 may have a first end 31, an open second end 32 and a peripheral wall 33 extending between the first 31 and open second 32 ends of the fire detectors 30. The first end 31 of the fire detectors may be mounted to the peripheral wall 24 of the conduit 20 and positioned along a length of the conduit providing fire detectors 30 over the entire area of the engine. The open second end 32 permits smoke or heat to enter the fire detector 30.

As illustrated in FIG. 3, a plurality of nozzles 35 is mounted to the conduit 20. Each of the nozzles 35 is positionable over each of the openings 21 extending through the conduit 20. Each of the nozzles 35 has a first end 36, an open second end 37 extending through the nozzle 35 and into the conduit 20 and a peripheral wall 38 extending between the first 36 and open second ends 37.

In one embodiment of the present invention, an outer diameter of each of the nozzles 35 tapers generally from a portion of the nozzles 35 between the first end 36 and the open second end 37 toward the open second end 37 of each of the nozzles 35. Each of the nozzles 35 provide for increased pressure by decreasing the diameter of the openings 21. Additionally, each of the nozzles 35 point and spray the fire extinguishant 17 in a more defined direction.

A fastening means 39 may be provided for fastening each of the canisters 12 and the conduit 20 to the vehicle. Any type of fastening means 39 may be employed such as, for example, u-shaped brackets and screws.

In use, a user mounts the canisters 12 and the conduit 20 to an area on the vehicle near the engine. A user may position the conduit in a pattern that provides better coverage of the engine in case of a fire. Once a fire is detected by the fire detectors 30, the valves 18 on the canisters 12 open permitting the fire extinguishant 17 to flow through the conduit and spray onto the engine putting the fire out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic fire extinguishing system for extinguishing an engine fire in a vehicle, the engine of the vehicle being mounted under a hood of the vehicle, said system comprising:

a pair of canisters being mountable to the vehicle, each of said canisters having an interior;

a fire extinguishant being positioned in said interior of said canister under pressure;

a valve being fluidly coupled to each of said canisters for controlling a flow of said fire extinguishant from each of said canisters;

a conduit being coupled to and extending between each of said valves such that each said canister is positioned at a respective end of said conduit, said conduit being for carrying said fire extinguishant flowing through each of said valves away from each of said canisters, wherein said conduit has a plurality of openings for emitting said fire extinguishant from said conduit; and at least one fire detector for detecting a fire and opening said valve on each of said canisters permitting said fire extinguishant to flow through said conduit exiting each of said openings and extinguishing a fire.

2. The automatic fire extinguishing system of claim 1, wherein said conduit has a first end, a second end and a peripheral wall extending between said first and second ends of said conduit.

3. The automatic fire extinguishing system of claim 2, wherein said conduit comprises a generally flexible material.

4. The automatic fire extinguishing system of claim 2, wherein said at least one fire detector is adapted for detecting a temperature of an engine above a predetermined temperature.

5. The automatic fire extinguishing system of claim 2, wherein said at least one fire detector is adapted for detecting smoke.

6. The automatic fire extinguishing system of claim 2, wherein said fire extinguishant comprises carbon dioxide.

7. The automatic fire extinguishing system of claim 2, additionally including a plurality of nozzles being mounted to said conduit and each of said nozzles being positionable over each of said openings extending through said conduit.

8. The automatic fire extinguishing system of claim 1, additionally including an intermediate wall being mounted in said conduit dividing said conduit into a first portion and a second portion, wherein said intermediate wall increases pressure of said fire extinguishant flowing through each of said portions of said conduit.

9. An automatic fire extinguishing system for extinguishing an engine fire in a vehicle, the engine of the vehicle being mounted under a hood of the vehicle, said system comprising:

a pair of canisters being mountable to the vehicle adjacent to the engine, each of said canisters having a first end, a second end and a peripheral wall extending between said first and second ends of each of said canisters defining an interior of each of said canisters;

said pair of canisters comprising a substantially rigid material;

a fire extinguishant being positioned in said interior of each of said canisters, said fire extinguishant being under pressure;

wherein said fire extinguishant comprises carbon dioxide;

a valve being mounted on each of said canisters for controlling a flow of said fire extinguishant from each of said canisters, each of said valves being mounted on one of said ends of said canister, each of said valves being in communication with said interior of each of said canisters;

a conduit being coupled to and extending between each of said valves for carrying said fire extinguishant flowing through said valves away from each of said canisters;

said conduit having a plurality of openings extending into said conduit for emitting said fire extinguishant from said conduit;

said conduit having a first end, a second end and a peripheral wall extending between said first and second ends of said conduit;

wherein said conduit comprises a generally flexible material;

wherein said conduit comprises a generally fire resistant material;

an intermediate wall being mounted in said conduit dividing said conduit into a first portion and a second portion, wherein said intermediate wall increases pressure of said fire extinguishant flowing through each of said portions of said conduit;

a plurality of fire detectors being mounted on said peripheral wall of said conduit for detecting a fire and opening said valves mounted on each of said canisters permitting said fire extinguishant to flow through said conduit exiting each of said openings and extinguishing a fire;

wherein each of said fire detectors is adapted for detecting a temperature above a predetermined temperature of a engine in a vehicle;

wherein each of said fire detectors is adapted for detecting smoke;

a plurality of nozzles being mounted to said conduit, each of said nozzles being positionable over each of said openings extending through said conduit, each of said nozzles having a first end, an open second end extending through said nozzle and into said conduit and a peripheral wall extending between said first and open second ends;

wherein an outer diameter of each of said nozzles tapers generally from a portion of said nozzle between said first end and said open second end toward said open second end of each of said nozzles; and a fastening means for fastening each of said canisters and said conduit to the vehicle.

* * * * *